US006508623B1

(12) United States Patent
Shiozaki et al.

(10) Patent No.: US 6,508,623 B1
(45) Date of Patent: Jan. 21, 2003

(54) GAS TURBINE SEGMENTAL RING

(75) Inventors: Shigehiro Shiozaki, Takasago (JP); Yasuoki Tomita, Takasago (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 79 days.

(21) Appl. No.: 09/959,310

(22) PCT Filed: Feb. 19, 2001

(86) PCT No.: PCT/JP01/01158

§ 371 (c)(1),
(2), (4) Date: Oct. 22, 2001

(87) PCT Pub. No.: WO01/66914

PCT Pub. Date: Sep. 13, 2001

(30) Foreign Application Priority Data

Mar. 7, 2000 (JP) ..... 2000-062492

(51) Int. Cl.[7] ..... F01D 11/24

(52) U.S. Cl. ..... 415/173.1; 415/115; 415/116; 415/139; 415/173.2; 415/178

(58) Field of Search ..... 415/173.1, 173.2, 415/173.3, 175, 176, 178, 115, 116, 138, 139

(56) References Cited

U.S. PATENT DOCUMENTS 3,990,807 A 11/1976 Sifford
6,019,572 A 2/2000 Cunha
6,302,642 B1 * 10/2001 Nagler et al. ..... 415/116

FOREIGN PATENT DOCUMENTS

| | | |
|---|---|---|
| JP | 9-512322 A | 12/1997 |
| JP | 11-13406 | 1/1999 |
| JP | 2961091 | 7/1999 |
| WO | 95/30072 | 11/1995 |

* cited by examiner

*Primary Examiner*—Christopher Verdier
(74) *Attorney, Agent, or Firm*—Wenderoth, Lind & Ponack, L.L.P.

(57) ABSTRACT

A gas turbine segmental ring has an increased rigidity to suppress a thermal deformation and enables less cooling air leakage by less number of connecting portions of segment structures. Cooling air (70) from a compressor flows through cooling holes (61) of an impingement plate (60) to enter a cavity (62) and to impinge on a segmental ring (1) for cooling thereof. The cooling air (70) further flows into cooling passages (64) from openings (63) of the cavity (62) for cooling an interior of the segmental ring (1) and is discharged into a gas path from openings of a rear end of the segmental ring (1). Waffle pattern (10) of ribs arranged in a lattice shape is formed on an upper surface of the segmental ring (1) to thereby increase the rigidity. A plurality of slits (6) are formed in flanges (4, 5) extending in the turbine circumferential direction to thereby absorb the deformation and thermal deformation of the segmental ring (1) is suppressed.

2 Claims, 6 Drawing Sheets

GAS TURBINE SEGMENTAL RING

TECHNICAL FIELD

The present invention relates to a gas turbine segmental ring made in such a structure that a cooling air leakage from connecting portions of segment structures is reduced as well as a thermal deformation in each of the segment structures and a restraining force caused by the thermal deformation are reduced.

BACKGROUND ART

FIG. 4 is a cross sectional view generally showing a front stage gas path portion of a gas turbine. In FIG. 4, immediately downstream of a fitting flange 31 of a combustor 30 in a flow direction of combustion gas 50, a first stage stationary blade (1*c*) 32 has both its ends fixed to an outer shroud 33 and inner shroud 34 and a plurality of the first stage stationary blades 32 are arranged in a turbine circumferential direction being fixed to an inner side of a turbine casing on a stationary side of the gas turbine. Downstream of the first stage stationary blade 32, a plurality of first stage moving blades (1*s*) 35 are arranged in the turbine circumferential direction being fixed to a platform 36. The platform 36 is fitted around a rotor disc and thus the moving blade 35 rotates together with a rotor (not shown). Along the turbine circumferential direction close to a tip of the moving blade 35, a segmental ring 42 of an annular shape formed of a plurality of segment structures is arranged being fixed to the turbine casing side.

Downstream of the first stage moving blade 35, a second stage stationary blade (2*c*) 37 has both its ends fixed to an outer shroud 38 and inner shroud 39 and likewise a plurality of the second stage stationary blades 37 are arranged in the turbine circumferential direction being fixed to the stationary side. Also, downstream thereof, a plurality of second stage moving blades (2*s*) 40 are arranged in the turbine circumferential direction being fixed to a rotor disc (not shown) via a platform 41. Along the turbine circumferential direction close to the tip of the moving blade 40, likewise a segmental ring 43 formed of a plurality of segment structures is arranged. The gas turbine having such a blade arrangement is usually constructed of four blade stages and the combustion gas 50 of a high temperature generated at the combustor 30 flows in the first stage stationary blade (1*c*) 32. While the combustion gas 50 passes through the respective blades of the second to the fourth stages, it expands to rotate the moving blades 35, 40, etc. and thus to rotate the rotor and is then discharged.

FIG. 5 is a cross sectional view showing a detail of the segmental ring 42 that is arranged close to the tip of the first stage moving blade 35, as described above. In FIG. 5, numeral 60 designates an impingement plate, that is fitted to a heat insulating ring 65 on the turbine casing side and comprises a plurality of through holes as cooling holes 61. The segmental ring 42 also is fitted to the heat insulating ring. 65 and comprises a plurality of cooling passages 64 bored in the respective segment structures along a turbine axial direction or along a direction of main flow gas 80. Each of the cooling passages 64 has at one end an opening 63 that opens in an upper surface of the segmental ring 42 on the upstream side and has at the other end an opening that opens in a circumferential side end surface of the segmental ring 42 on the downstream side, as shown in FIG. 5.

In the construction described above, cooling air 70 bled from a compressor or supplied from an outside cooling air supply source flows through the cooling holes 61 of the impingement plate 60 to enter a cavity 62 below the impingement plate 60 and to impinge on the segmental ring 42 for effecting a forced cooling or impingement cooling of the segmental ring 42. Then, the cooling air 70 in the cavity 62 flows into the cooling passages 64 from the openings 63 for cooling an interior of the segmental ring 42 and is discharged into the main flow gas 80 from the openings of the rear end of the segmental ring 42.

FIG. 6 is a partial perspective view of the segmental ring 42 described above. As shown there, the segmental ring 42 is formed in the annular shape of the plurality of segment structures arranged and connected to one another in the turbine circumferential direction. The impingement plate 60 is arranged above, or on the outer side of, the segmental ring 42 and the cavity 62 is formed between the impingement plate 60 and a recessed portion of the upper side of the segmental ring 42. Thus, as mentioned above, the cooling air 70 entering the cavity 62 through the cooling holes 61 impinges on an upper wall surface of the segmental ring 42 to forcibly cool the segmental ring 42 and then flows through the cooling passages 64 to cool the interior of the segmental ring 42 and is discharged into the main flow gas 80.

In the gas turbine segmental ring, in order to prevent a reverse flow of the main flow gas 80, pressure of the cooling air 70 in the cavity 62 is made higher relative to that of the main flow gas 80. Hence, in addition to the amount of the cooling air flown through the segmental ring 42 and effectively used for the cooling thereof, there is some amount of the air leaking from connecting portions of the segment structures of the segmental ring 42. Thus, as the number of the segment structures becomes larger, the number of the connecting portions thereof becomes larger and the amount of the leaking air becomes also larger, which results in the reduction of the cooling efficiency. Moreover, as the surface of the segmental ring 42 is directly exposed to the high temperature main flow gas 80, unusual force due to thermal deformation of the segment structures may arise so that a roundness of the segmental ring 42 may be hardly maintained, which results in causing an increase of the air amount leaking from the connecting portions and in giving an unfavorable influence on the clearance between the tip of the moving blade 35 and the segmental ring 42.

DISCLOSURE OF THE INVENTION

In view of the problems in the prior art, it is an object of the present invention to provide a gas turbine segmental ring made in such a structure that the number of segment structures forming the segmental ring is lessened so as to reduce a cooling air leakage amount and each of the segment structures is formed so as to reduce a thermal deformation thereof as well as to absorb a distortion caused by the thermal deformation.

In order to achieve the mentioned object, the present invention provides the means of the following inventions (1) and (2):

(1) A gas turbine segmental ring formed in an annular shape of a plurality of segment structures connected to one another in a turbine circumferential direction and arranged to be fitted to an inner circumferential surface of a turbine casing with a predetermined clearance being maintained between itself and a tip of a moving blade, each of the segment structures having at its turbine axial directional front and rear end portions flanges extending in the turbine circumferential direction to be fitted to the turbine casing, characterized in that each of the segment structures is constructed such that the flanges have their flange portions cut in so that a plurality of slits may be formed along the turbine axial direction and a plurality of ribs arranged to form a lattice shape are provided to project from an upper surface existing between the flanges of the segment structure.

(2) A gas turbine segmental ring as mentioned in the invention (1) above, characterized in being formed in the annular shape of 15 pieces of the segment structures.

In the invention (1) above, as the plurality of slits are formed in the flanges to be fitted to the turbine casing, even if the thermal deformation may arise, it can be absorbed by the deformation of these slits. Also, as the waffle pattern of the ribs is formed on the upper bottom surface of the segment structure to increase the rigidity, the thermal deformation of the segment structures can be suppressed to the minimum and the roundness of the segmental ring can be secured.

In the invention (2) above, the annular shape of the segmental ring is formed of the 15 pieces of the segment structures, which is a half of 30 pieces of the segment structures of the prior art case. Thereby, the connecting portions of the segment structures are also reduced to the half of the prior art case, the cooling air amount leaking from the connecting portions can be remarkably reduced and the cooling efficiency can be greatly enhanced.

BEST MODE FOR CARRYING OUT THE INVENTION

Figure 1A:
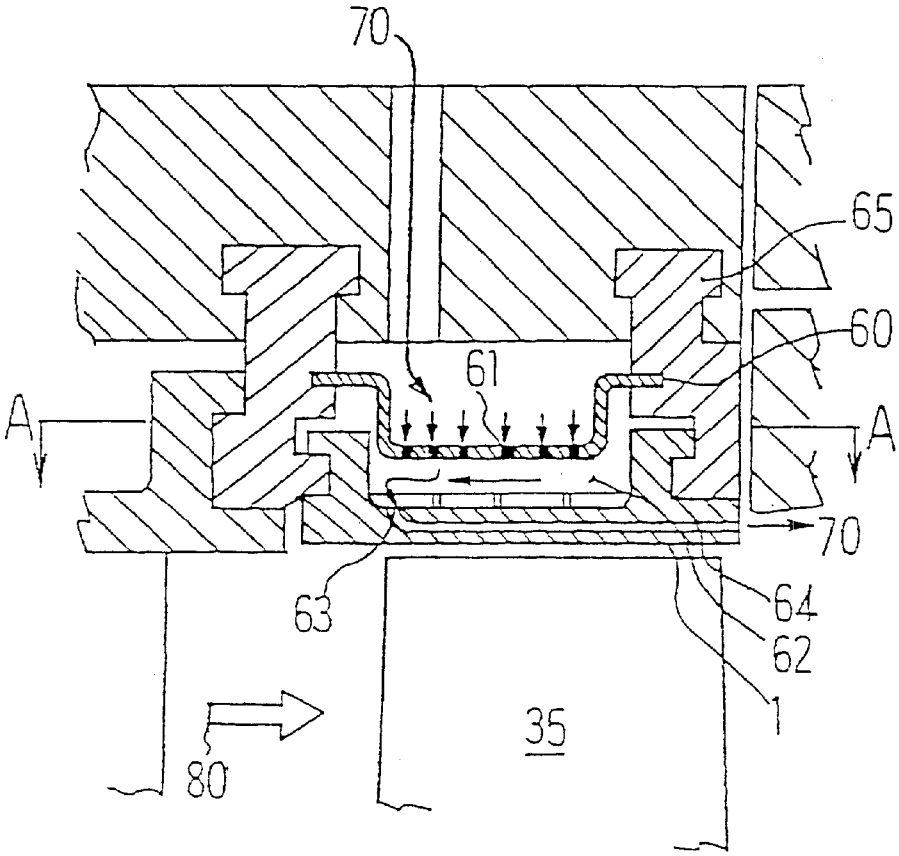
FIGS. 1(*a*) and 1(*b*) show a gas turbine segmental ring of one embodiment according to the present invention, wherein FIG. 1(*a*) is a cross sectional view and FIG. 1(*b*) is a view seen from line A—A of FIG. 1(*a*).
Figure 1B:
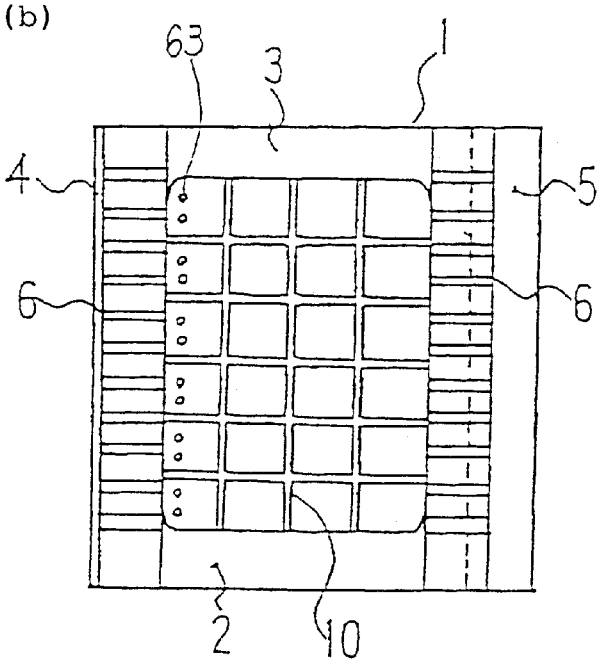
Figure 5:
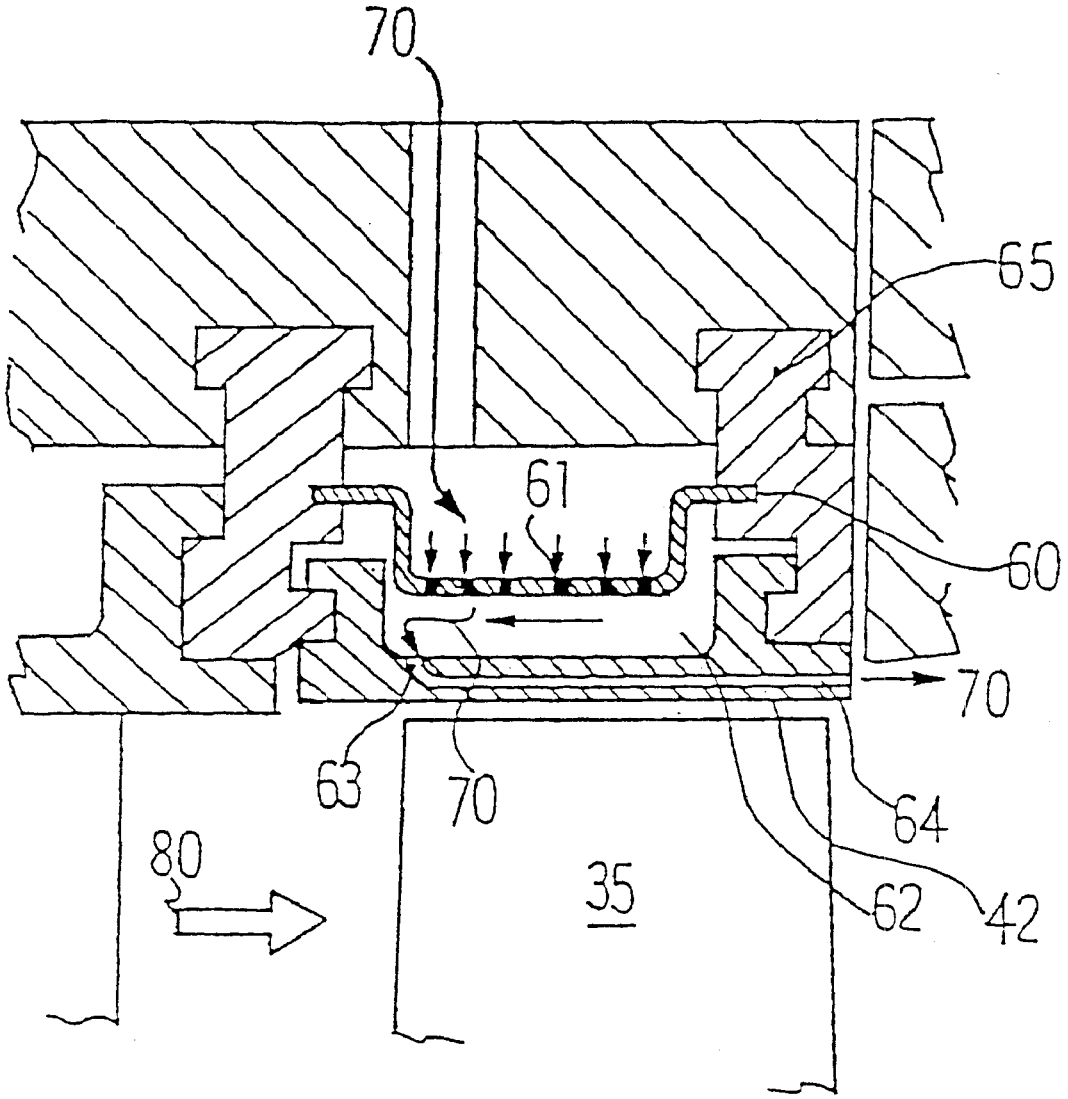
Fig. 5 (Prior Art)
FIG. 5 is a cross sectional view showing a detail of a gas turbine segmental ring in the prior art.
Figure 6:
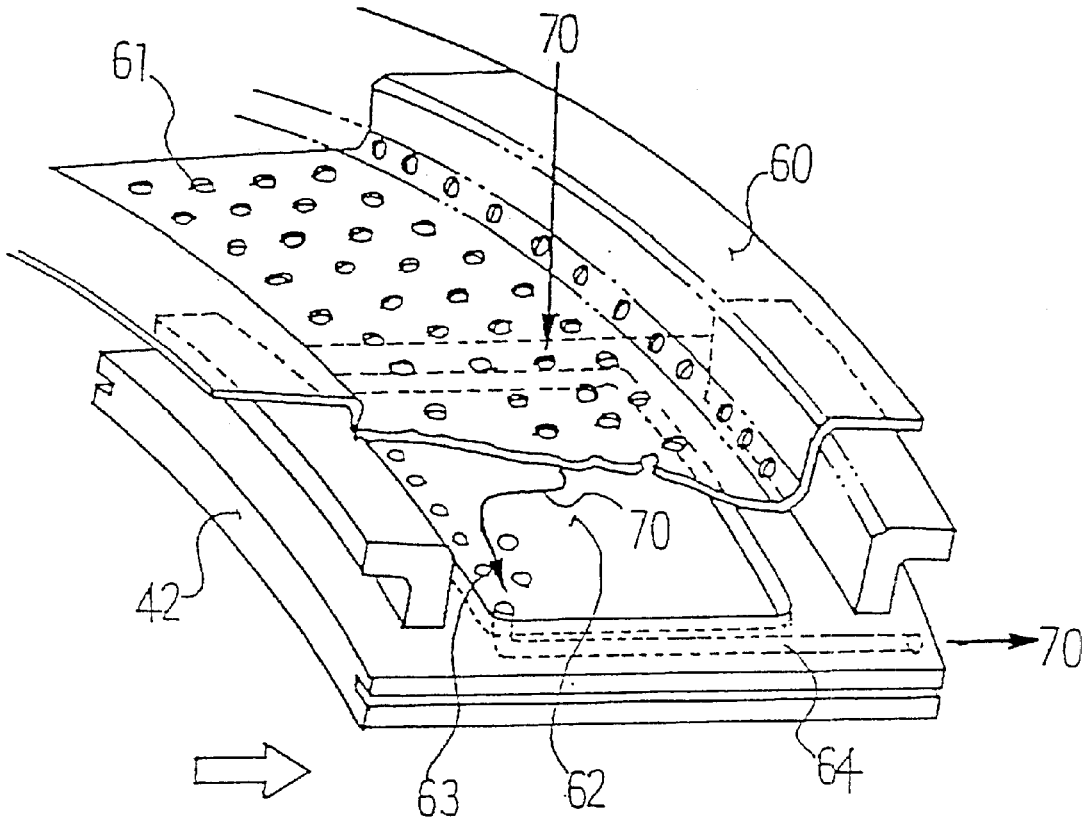
Fig. 6 (Prior Art)
FIG. 6 is a partial perspective view of the segmental ring of FIG. 5.

Herebelow, an embodiment according to the present invention will be described with reference to figures. FIGS. 1(*a*) and 1(*b*) show a gas turbine segmental ring of the embodiment according to the present invention, wherein FIG. 1(*a*) is a cross sectional view and FIG. 1(*b*) is a view seen from line A—A of FIG. 1(*a*). In FIGS. 1(*a*) and 1(*b*), like in the prior art case shown in FIG. 5, a segmental ring 1 is formed in an annular shape of a plurality of segment structures arranged and connected to one another in the turbine circumferential direction. The segmental ring 1 is fitted to the heat insulating ring 65 and comprises a plurality of cooling passages 64 bored therein, each of the cooling passages 64 having at one end an opening 63 that opens into the cavity 62 and at the other end an opening that opens toward the downstream side in a circumferential side end surface of the segmental ring 1. Further, the same impingement plate 60 as the prior art one is fitted to the heat insulating ring 65. Each of the segment structures of the segmental ring 1 comprises flanges 4, 5, to be fitted to the turbine casing side, erecting from front and rear end portions of the segment structure and extending in the turbine circumferential direction as well as flanges 2, 3 erecting from circumferential end portions of the segment structure and extending in the turbine axial direction. Thus, a concave portion is formed being surrounded by the four flanges 2, 3, 4 and 5 on the upper side of each of the segment structures.

Each of the flanges 4, 5 extending in the circumferential direction is partially cut in so as to form a plurality of slits 6 along the axial direction and thus the flange is made in such a structure that a bending or distorting force caused by the thermal deformation is absorbed by the plurality of slits 6 to thereby prevent the deformation. It is preferable that the number of the slits 6 per flange is 5 or more. On an upper bottom surface of the concave portion of the segment structure, a plurality of ribs arranged in a lattice shape are provided to project from the bottom surface so that a waffle pattern 10 is formed to thereby strengthen the rigidity of the bottom portion of the concave portion. In FIG. 1(*b*), an example of the waffle pattern 10 having three ribs along the circumferential direction and five ribs along the axial direction is shown but the number of the ribs is not limited to this example.

Figure 2:
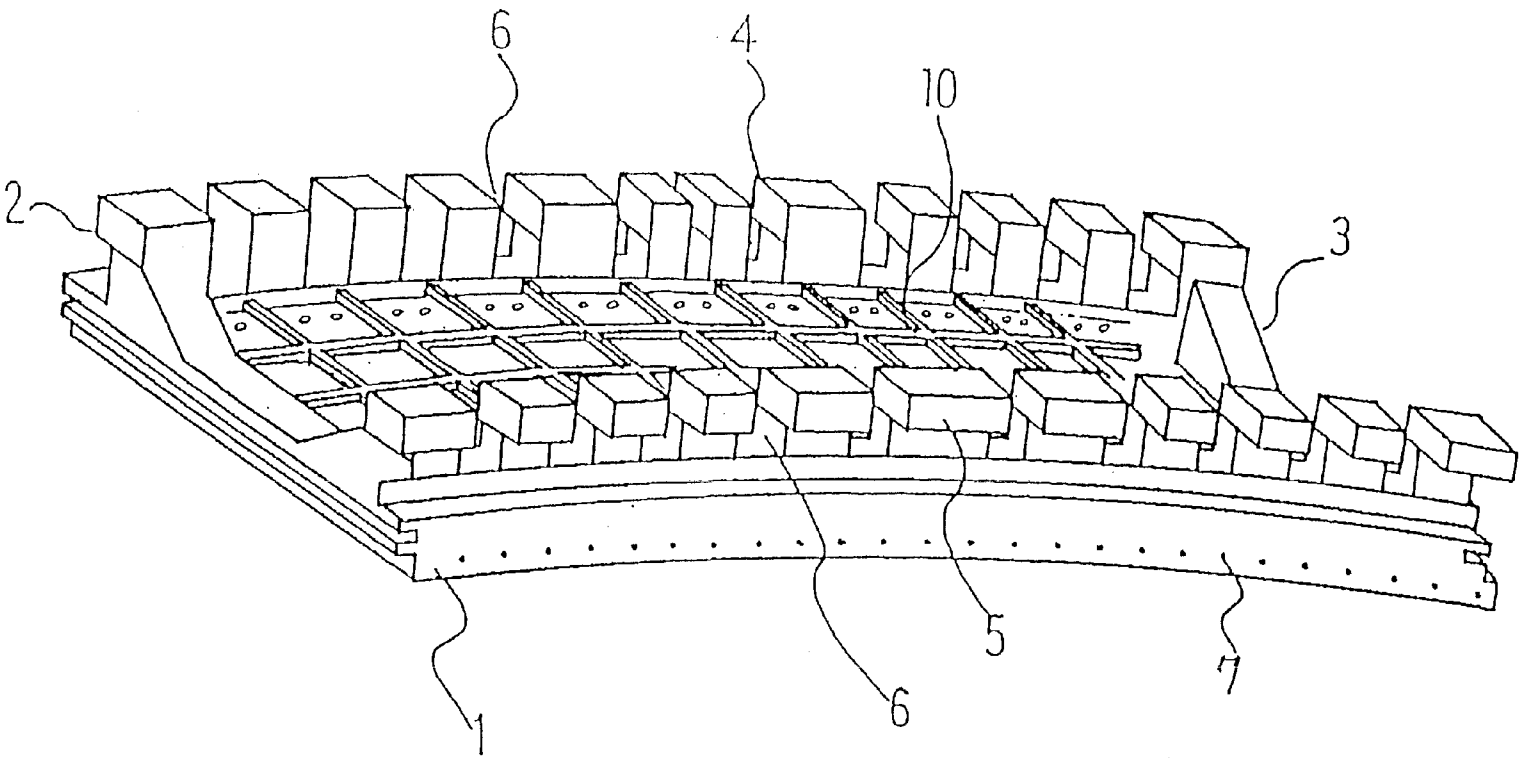
FIG. 2 is a perspective view of one of segment structures forming the segmental ring of FIG. 1.

FIG. 2 is a perspective view of the segment structure described above. There are provided a plurality of the slits 6 in the flanges 4, 5 extending in the turbine circumferential direction at the front and rear end portions of the segmental ring 1. Each of the slits 6 is formed in the most favorable shape in terms of the work thereof. The waffle pattern 10 of the lattice shape is formed on the bottom surface of the concave portion of the segment structure and a plurality of cooling passages 7 are provided in the interior of the segment structure. Thus, one of the segment structures forming the segmental ring 1 is so constructed, and a plurality of such segment structures are connected to one another to form the segmental ring 1 of the annular shape. The segmental ring 1 is arranged close to the tip of the moving blade so as to maintain an appropriate clearance therebetween. The number of pieces of the segment structures forming one segmental ring, as described below with respect to FIGS. 3(*a*) and 3(*b*), is made as small as 15 pieces, as compared with 30 pieces of the conventional case, so that connecting portions of the segment structures may be reduced and cooling air amount leaking from the connecting portions may also be reduced.

In the segmental ring shown in FIG. 1 and constructed as mentioned above, cooling air 70 bled from a compressor or supplied from an outside supply source flows through the cooling holes 61 of the impingement plate 60 to enter the cavity 62 and to impinge on the upper bottom surface of the segmental ring 1 for effecting a forced cooling or impingement cooling of the segmental ring 1. Then, the cooling air 70 flows into the cooling passages 64 from the openings 63 for cooling the interior of the segmental ring 1 and is discharged into the main flow gas 80 from the openings of the rear end of the segmental ring 1.

In the segmental ring 1 that is exposed to the high temperature gas, while a deformation may arise due to the occurrence of distortion caused by the temperature difference between the lower surface portion that is exposed to the high temperature gas and the upper surface portion on the cavity 62 side, the waffle pattern 10 is formed on the upper surface on the cavity 62 side to thereby strengthen the rigidity and so the deformation can be suppressed to the minimum. Also, a deformation that may be caused in the flanges 4, 5 is absorbed by the deformation of the plurality of slits 6 so that the roundness of the segmental ring 1 may not be changed.

Figure 3A:
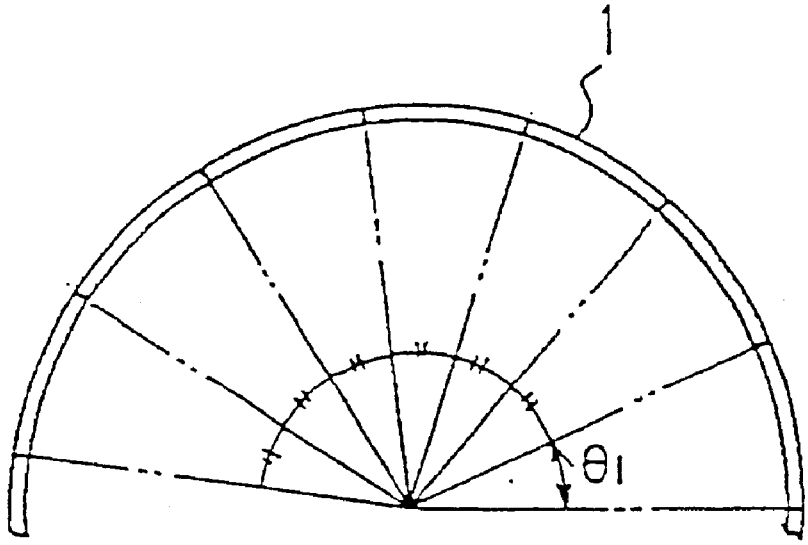
FIGS. 3(*a*) and 3(*b*) are front views showing an upper half portion of the segmental ring for explaining the number of pieces of the segment structures, wherein FIG. 3(*a*) is of the present invention and FIG. 3(*b*) is of the prior art.
Figure 3B:
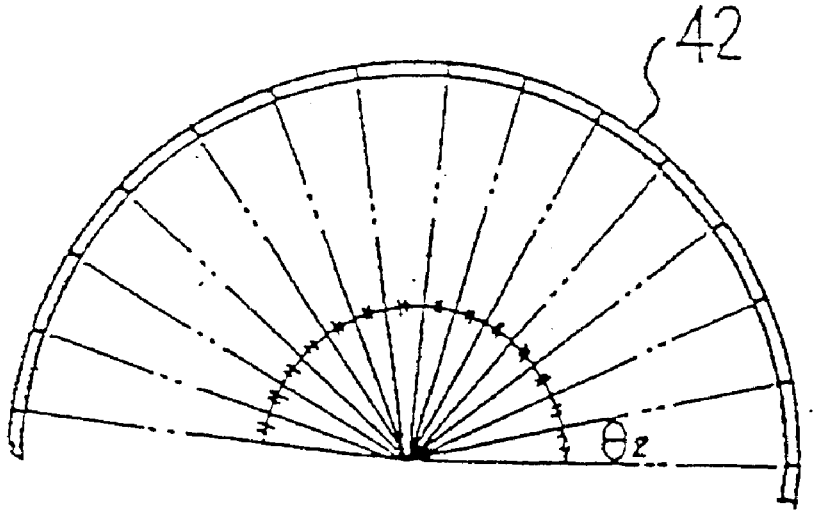
Fig. 3(b) (Prior Art)
Figure 4:
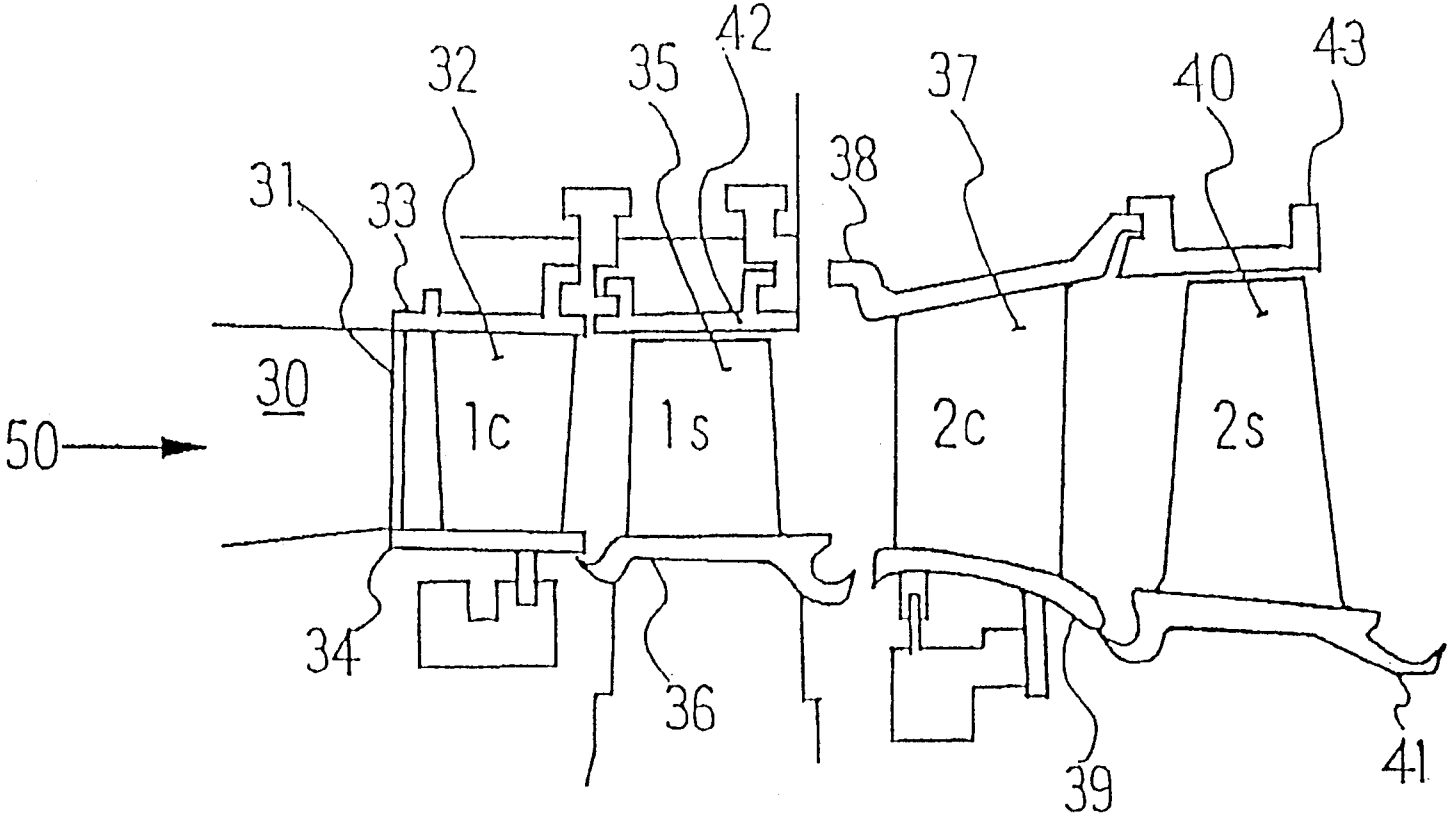
Fig. 4 (Prior Art)
FIG. 4 is a cross sectional view generally showing a front stage gas path portion of a gas turbine in the prior art.

FIGS. 3(*a*) and 3(*b*) are front views showing an upper half portion of the segmental ring for explaining the number of pieces of the segment structures forming the segmental ring, wherein FIG. 3(*a*) is of the present invention and FIG. 3(*b*) is of the prior art. In the prior art segmental ring shown in FIG. 3(*b*), $\theta_2$ is 12 degrees ($\theta_2$=12°) and 30 pieces of the ring segments are arranged and connected to one another in the annular shape. On the other hand, in the present invention shown in FIG. 3(*a*), each of the segment structures is elongated in the circumferential direction so that $\theta_1$ is set to 24 degrees ($\theta_1$=24°) and 15 pieces of the segment structures, which is a half of the prior art case, are arranged and connected to one another in the annular shape. By so connecting the elongated segment structures in the annular shape, the number of the segment structures is lessened, the connecting portions thereof are reduced and the air amount leaking from the connecting portions can be reduced.

According to the gas turbine segmental ring of the described embodiment, the plurality of slits 6 are provided in the flanges 4, 5 extending in the turbine circumferential direction at the front and rear ends of the segmental ring 1 and the waffle pattern 10 is formed on the upper bottom surface of the segmental ring 1. Thereby, the thermal deformation of the segmental ring 1 is suppressed as well as absorbed and the roundness of the segmental ring 1 can be secured. Moreover, the number of pieces of the segment structures is set to 15 pieces, which is a half of 30 pieces of the prior art case, and the connecting portions are reduced. Hence, the air amount leaking from the connecting portions can be reduced and the cooling effect can be enhanced.

INDUSTRIAL APPLICABILITY

The present invention provides the gas turbine segmental ring formed in an annular shape of a plurality of segment structures connected to one another in a turbine circumferential direction and arranged to be fitted to an inner circumferential surface of a turbine casing with a predetermined clearance being maintained between itself and a tip of a moving blade, each of the segment structures having at its turbine axial directional front and rear end portions flanges extending in the turbine circumferential direction to be fitted to the turbine casing, characterized in that each of the segment structures is constructed such that the flanges have their flange portions cut in so that a plurality of slits may be formed along the turbine axial direction and a plurality of ribs arranged to form a lattice shape are provided to project from an upper surface existing between the flanges of the segment structure.

By this construction, as the plurality of slits are formed in the flanges to be fitted to the turbine casing, even if the thermal deformation may arise, it can be absorbed by the deformation of these slits. Also, as the waffle pattern of the ribs is formed on the upper bottom surface of the segment structure to increase the rigidity, the thermal deformation of the segment structures can be suppressed to the minimum and the roundness of the segmental ring can be secured.

The present invention further provides the gas turbine segmental ring as mentioned above, characterized in being formed in the annular shape of 15 pieces of the segment structures. By this construction, the annular shape of the segmental ring is formed of the 15 pieces of the segment structures, which is a half of 30 pieces of the segment structures of the prior art case. Thereby, the connecting portions of the segment structures are also reduced to the half of the prior art case, the cooling air amount leaking from the connecting portions can be remarkably reduced and the cooling efficiency can be greatly enhanced.

What is claimed is:

1. A gas turbine segmental ring formed in an annular shape of a plurality of segment structures connected to one another in a turbine circumferential direction and arranged to be fitted to an inner circumferential surface of a turbine casing with a predetermined clearance being maintained between itself and a tip of a moving blade, each of said segment structures having at its turbine axial directional front and rear end portion flanges extending in the turbine circumferential direction to be fitted to the turbine casing, wherein each of said segment structures is constructed such that said flanges have their flange portions cut in so that a plurality of slits are formed along the turbine axial direction and a plurality of ribs arranged to form a lattice shape are provided to project from an upper surface existing between said flanges of the segment structure.

2. A gas turbine segmental ring as claimed in claim 1, being formed in the annular shape of fifteen pieces of said segment structures.

* * * * *